US009963204B2

(12) United States Patent
Franke

(10) Patent No.: US 9,963,204 B2
(45) Date of Patent: May 8, 2018

(54) LOW-RESISTANCE BOAT HULL

(71) Applicant: Peter Franke, Toronto (CA)

(72) Inventor: Peter Franke, Toronto (CA)

( * ) Notice: Subject to any disclaimer, the term of this patent is extended or adjusted under 35 U.S.C. 154(b) by 0 days. days.

(21) Appl. No.: 14/093,460

(22) Filed: Nov. 30, 2013

(65) Prior Publication Data

US 2015/0151814 A1 Jun. 4, 2015

(51) Int. Cl.

| | |
|---|---|
| ***B63B 1/00*** | (2006.01) |
| ***B63B 1/38*** | (2006.01) |
| ***B63B 1/04*** | (2006.01) |
| ***B63B 35/71*** | (2006.01) |
| *B63B 1/06* | (2006.01) |

(52) U.S. Cl.

CPC ..... *B63B 1/38* (2013.01); *B63B 1/042* (2013.01); *B63B 35/71* (2013.01); *B63B 2001/066* (2013.01)

(58) Field of Classification Search

CPC .. B63B 1/38; B63B 1/20; B63B 1/042; B63B 1/08

USPC ..... 114/288, 290

See application file for complete search history.

(56) References Cited

U.S. PATENT DOCUMENTS 3,470,839 A * 10/1969 Sherman ..... B63B 1/042 114/61.21

6,834,605 B1 * 12/2004 Franke ..... 114/61.32

* cited by examiner

*Primary Examiner* — Anthony D Wiest

(57) ABSTRACT

A hull configuration has a bow and a stern, and is for use in a single or multiple hull vessel. The hull configuration comprises: a pair of cutting edges, each cutting edge sloping rearwardly, downwardly and in an outwardly lateral direction, from the bow; a pair of keels, each keel extending longitudinally rearwardly and laterally inwardly from an end of a respective one of the cutting edges and converging at the stern; a pair of sidewalls, each sidewall extending generally upwardly from a respective one of the cutting edges and from a respective one of the keels, the sidewalls extending rearwardly to the stern; and a bottom channel defined between the cutting edges and between the keels. The channel comprises a forward portion having a concave upper surface and rearward portion having a planar upper surface. The channel decreases in width from ends of the cutting edges towards the stern.

6 Claims, 2 Drawing Sheets

LOW-RESISTANCE BOAT HULL

FIELD OF THE INVENTION

The present invention relates in general to low-resistance elongate boat or ship hulls for use in a single hull or multiple hull watercraft such as kayaks, catamarans, trimarans, or other watercraft.

BACKGROUND OF THE INVENTION

A variety of different boat hull configurations have been developed for use in a variety of watercraft. Continued desire for increased speed and efficiency of boats drives further developments in boat hull configurations.

In certain prior art watercraft, the boat hull is substantially V-shaped for cutting through water when in use. Unfortunately, such V-shaped hulls often lack stability on the water. In other prior art watercraft such as catamarans, flat bottom hulls are employed for the purpose of providing a stable ride. Such hulls, however, provide this stable ride at the cost of speed when travelling on the water. Skin friction is high in these boats as a large surface area of the hull is in contact with the water. Similarly, resistance is high as water is displaced away from the hull forming waves as the hull moves through the water.

In still other prior art watercraft, channels are provided in the hull bottom for producing dynamic lift and trapping air for the purpose of lubricating the hull. Bulbous-nosed hulls have also been employed to reduce the amount of water that has to be accelerated by the bow by allowing water that is in the path of a moving hull to be moved around the hull in the direction of least resistance.

Improvements are desired. It is an object of an aspect of the present invention to provide a low-resistance hull configuration for single or multiple hull watercraft.

SUMMARY OF THE INVENTION

In one aspect, there is provided a hull configuration comprised of four components that together are greater than the sum of the individual parts. The hull configuration includes, among other features, a pair of cutting edges, a pair of keels, a pair of sidewalls, and a bottom channel.

In one aspect, there is provided a hull configuration having a bow and a stern, for use in a single or multiple hull vessel, the hull configuration comprising: a pair of cutting edges, each cutting edge sloping rearwardly, downwardly and in an outwardly lateral direction, from the bow; a pair of keels, each keel extending longitudinally rearwardly and laterally inwardly from an end of a respective one of the cutting edges and converging at the stern; a pair of sidewalls, each sidewall extending generally upwardly from a respective one of the cutting edges and from a respective one of the keels, the sidewalls extending rearwardly to the stern; and a bottom channel defined between the cutting edges and between the keels, the channel comprising a forward portion having a concave upper surface and rearward portion having a planar upper surface, the channel decreasing in width from ends of the cutting edges towards the stern.

Advantageously, skin-friction of the boat hull is reduced by reducing the wetted surface area of the hull and by using air that is trapped in the channel to lubricate the hull. Also, the wave-making resistance of the hull is reduced by reducing the acceleration of water in the path of the moving hull.

Drag is reduced by reducing the acceleration of the water which is dragged into the space that is vacated by the moving hull.

In one aspect, water is displaced and replaced simultaneously by allowing the movement of water to occur over the entire length of the hull. Water that is moved up by the bow and which is pushed down by the channel also fills in the space that is vacated by the moving hull. Drag is reduced while reducing wave-making resistance by allowing the water to flow from the channel around the convex sides into the space vacated by the moving hull. The water takes the path of least resistance and movement of the hull is facilitated by the convex sides of the hull.

In one embodiment, each of said sidewalls spiral rearwardly from a respective one of said cutting edges. Each of the sidewalls may extend inwardly and upwardly proximal the bow, substantially vertically proximal a midpoint between the bow and the stern, and substantially vertically proximal the stern.

In another embodiment, an inner surface of each keel defines a generally right angle with the planar upper surface of the channel.

In another embodiment, the forward portion of the channel blends smoothly with the rearward portion of the channel. The forward portion of the channel may blend smoothly with the rearward portion of the channel proximal a midpoint between the bow and the stern.

In another embodiment, the depth of the channel increases from the bow proximal a midpoint between the bow and the stern, and decreases rearwardly therefrom to the stern.

BRIEF DESCRIPTION OF THE DRAWINGS

The invention will be better understood with reference to the drawings and to the following description, in which.

DETAILED DESCRIPTION OF THE EMBODIMENTS

Figure 1:
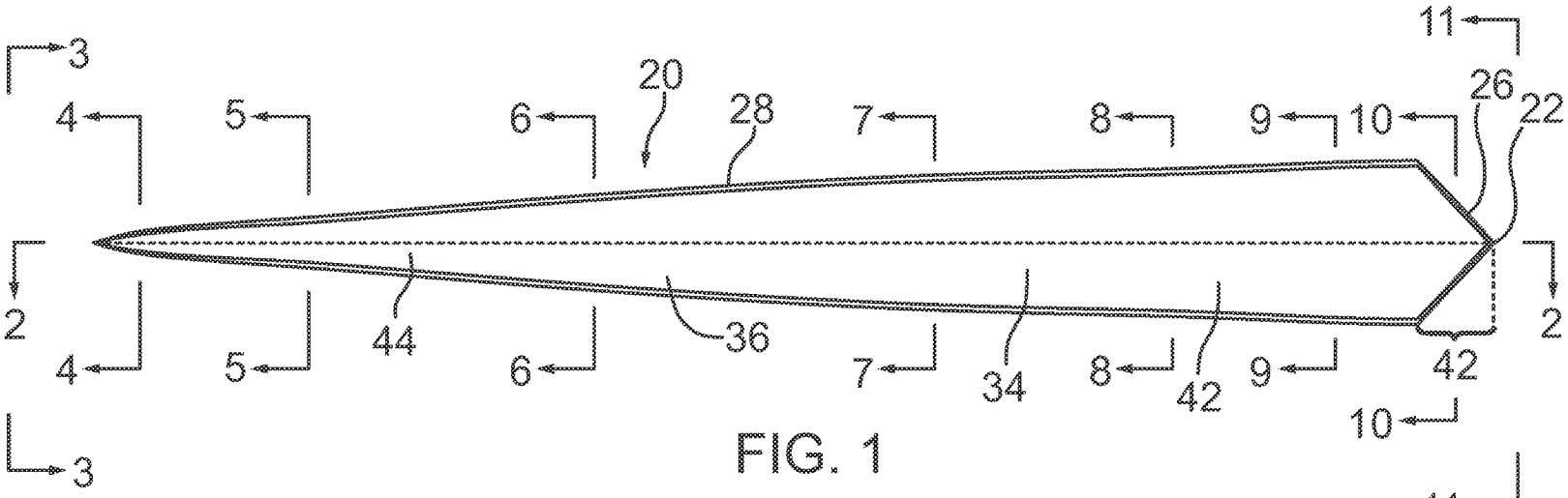
FIG. 1 is a bottom view of a boat hull.
Figure 2:
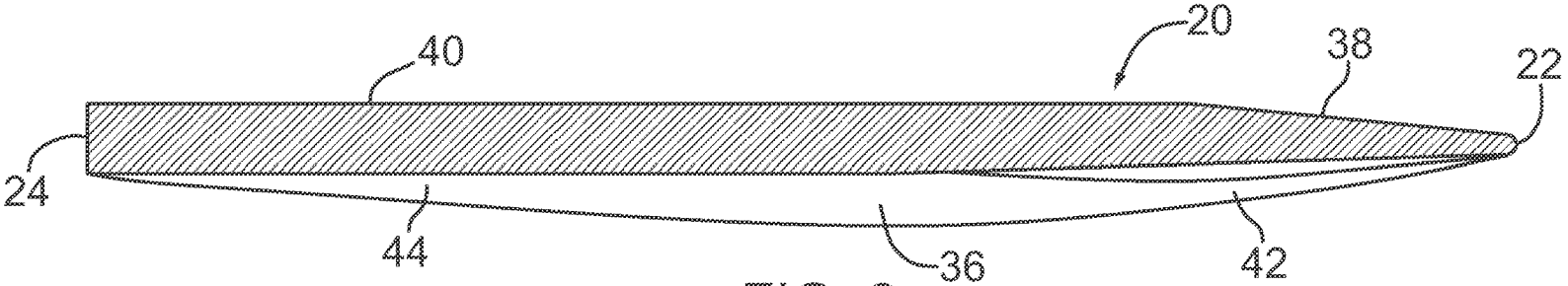
FIG. 2 is a cross-sectional side view of the boat hull of FIG. 1, taken along the lines 2-2.
Figure 3:
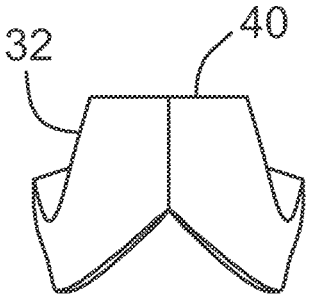
FIG. 3 is a rear view of the boat hull of FIG. 1.
Figure 4:
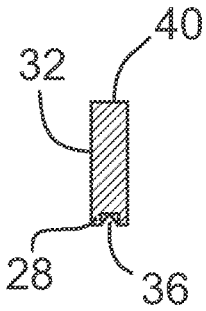
FIG. 4 is a sectional view of the boat hull of FIG. 1, taken along the lines 4-4.
Figure 5:
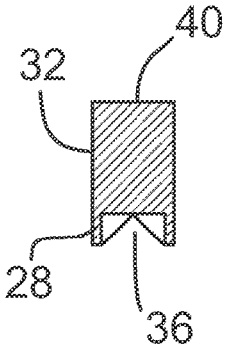
FIG. 5 is a sectional view of the boat hull of FIG. 1, taken along the lines 5-5.
Figure 6:
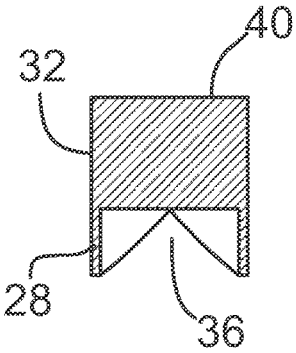
FIG. 6 is a sectional view of the boat hull of FIG. 1, taken along the lines 6-6.

Turning now to FIGS. 1 to 11, a hull is shown and is generally indicated by reference numeral 20. For ease of reference, the hull is described herein in the orientation in which it is used in water. Hull 20 has a bow 22 and a stern 24, and comprises a pair of forward cutting edges 26. The bow 22 is defined by the convergence of the cutting edges 26 at a rounded edge, as may be best seen in profile in FIG. 2. From the bow 22, the cutting edges 26 extend downwardly, rearwardly and laterally outwardly. These cutting edges 26 broaden with distance from the bow 22, and transition smoothly into the outer sides of keels 28, as may be best seen in FIG. 11.

The hull 20 also comprises a pair of keels 28. Each keel 28 extends longitudinally rearwardly and laterally inwardly from the end of a respective cutting edge 26 (the lower most point of the cutting edges 26), and smoothly converges with the other keel 28 at the stern 24.

The hull 20 also has a pair of sidewalls 32 forming an upper portion of the hull 20. Each sidewall 32 extends rearwardly from a respective cutting edge 26. The sidewalls 32 extend rearwardly from the cutting edges 26 toward the stern 24. As may be seen in FIGS. 4 to 10, the sidewalls 32 transition smoothly from the bow 22 to the stern 24, each forming a smooth rearward spiral. At a forward portion of the hull 20, the sidewalls 32 extend upwardly and inwardly towards each other and intersect along an inclined ridge 38. Rearward of the inclined ridge 38, but still forward of the midpoint of the hull 20, the sidewalls 32 extend upwardly and inwardly to a top deck 40. In this embodiment, rearward of the midpoint of the hull 20, the sidewalls 32 become generally coplanar with the outer surfaces of the keels 28, and extend generally vertically to the top deck 40. The sidewalls 32 continue to remain generally coplanar with the outer surfaces of the keels 28 and continue to extend generally vertically to the top deck 40 rearwardly to the stern 24.

The hull 20 also has an underside 34 that includes a channel 36. The channel 36 begins at the bow 22, and extends between the cutting edges 26 and between the keels 28 to the stern 24. The width of the channel 36 decreases from the ends of the cutting edges 26 to the stern 24. The channel 36 comprises two portions, namely a forward portion 42 comprising a generally concave surface extending between the keels 28, and a rearward portion 44 comprising a generally planar surface extending between the keels 28. As the inner surfaces of the keels 28 are generally vertical, the generally planar surface of the rearward portion 44 of the channel 36 defines a generally right angle with the inner surface of each keel 28. The forward portion 42 blends smoothly with the rearward portion 44 near the midpoint, as may be seen in FIG. 2 and in the sections shown in FIGS. 6 to 8. In the embodiment shown, the forward portion 42 blends smoothly with the rearward portion 44 at a location generally corresponding to the section shown in FIG. 7. The depth of the channel 36 increases from the bow 22 to a point near the midpoint, as may be seen in FIG. 2, and then decreases from the point near the midpoint to the stern 24. Thus, the depth of the channel 36 is greater at the section shown in FIG. 7 than at the section shown in each of FIGS. 6 and 8.

As will be appreciated, the shape of the channel 36, and in particular the rearward portion 44 of the channel 36 comprising the generally planar surface extending between the keels 28, advantageously permits a greater volume of air to be accommodated in the channel 36 for providing lubrication. As will be understood, the greater volume of air accommodated within the channel 36 in turn provides increased speed and efficiency to the hull 20. Additionally, and as will be appreciated, the simple shape of the channel 36, and in particular the rearward portion 44 of the channel 36, allows the hull 20 to be constructed more easily than hulls having channels of other shapes.

As will be appreciated, the efficiency of the bow and forward portion of the channel has already been proven and demonstrated, and is described for example in U.S. Pat. No. 6,834,605 to Franke and issued Dec. 28, 2004, the content of which is incorporated by reference herein in its entirety. However, it has been found by the inventor that the "rectangular" rearward portion of the channel used in combination with the "concave" forward portion and bow greatly improves air lubrication and generally makes better use of hydraulic principles. As will be understood, as the width of the channel narrows toward the stern, the air pressure therein increases (and, as a result of hydraulics, is evenly distributed across the channel) for providing improved lubrication.

As will be appreciated, the nature of the design lends itself well to general "optimization" of the final profile through experimentation. The ease of construction of the design, and the generally narrow keels, aid in determining the maximum efficiency (or at least a near maximum efficiency) for a given cruising speed at a given load. A designer can start with keels of maximum depth, and then shave the keels down to reduce their depth, and then tested iteratively. Each time the keel profile can be tested at different speeds and with different loads until the maximum efficiency (or at least a near maximum efficiency) is determined, resulting in an "optimized" final profile.

The hull 20 as described herein may be made of any suitable material. For example, in this embodiment, the hull 20 is made of wood. In this embodiment, plywood sheets are twisted to form the sidewalls 32. In other embodiments, the hull 20 may alternatively be made of one or more other suitable materials known to those skilled in the art of boat hulls and boat construction.

Other variations and modifications are possible. For example, the size and shape of many of the elements can vary. Also, the sidewall configuration can vary. For example, when used in a kayak or as pontoons on a float plane, the sidewalls 32 may alternatively slope inwardly along the entire length of the hull 20. Also, the hull 20 can be used as a buoyant keel, on the bottom of a larger hull. The exact size and shape of the components described herein can vary and can be experimentally or otherwise determined. The hull 20 may alternatively be equipped with one or more cockpits when used in a kayak.

Although in the embodiment described above, the inner surfaces of the keels are generally vertical, in other embodiments, the inner surfaces of the keels may alternatively not be generally vertical and may alternatively be inclined. In still other embodiments, the inner surface of at least a portion of each keel may alternatively not be generally vertical and may alternatively be inclined. Moreover, although in the embodiment described above, the generally planar surface of the rearward portion of the channel defines a generally right angle with the inner surface of each keel, in other embodiments, the generally planar surface of the rearward portion of the channel may alternatively define a non-right angle with the inner surface of each keel.

Figure 7:
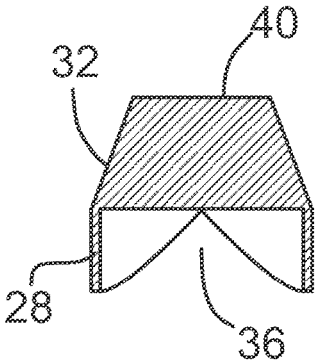
FIG. 7 is a sectional view of the boat hull of FIG. 1, taken along the lines 7-7.
Figure 8:
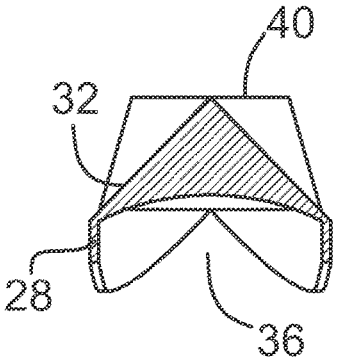
FIG. 8 is a sectional view of the boat hull of FIG. 1 taken along the lines 8-8.
Figure 9:
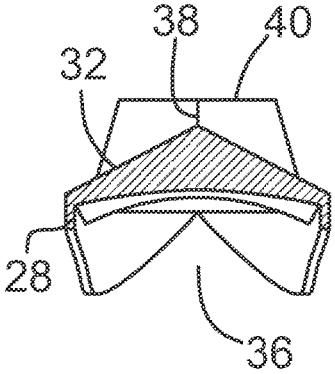
FIG. 9 is a sectional view of the boat hull of FIG. 1 taken along the lines 9-9.
Figure 10:
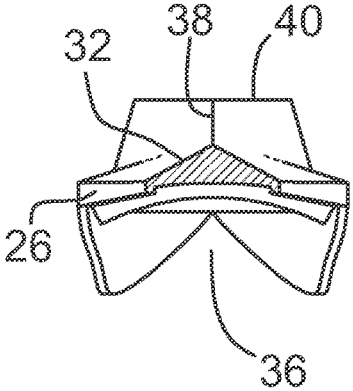
FIG. 10 is a sectional view of the boat hull of FIG. 1 taken along the lines 10-10.
Figure 11:
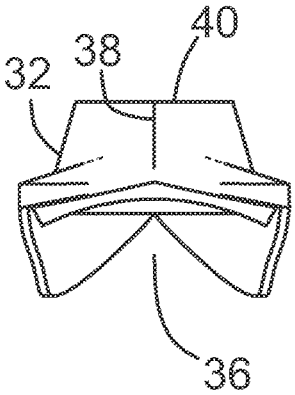
FIG. 11 is a front view of the boat hull of FIG. 1.

Although in the embodiment described above, the forward portion blends smoothly with the rearward portion at a location near the midpoint and generally corresponding to the section shown in FIG. 7, in other embodiments, the forward portion may alternatively blend smoothly with the rearward portion at a different location along the hull.

Although in the embodiment described above, the depth of the channel increases from the bow to a point near the midpoint, and then decreases from the point near the midpoint to the stern, in other embodiments, the depth of the channel may alternatively have a different profile along the length of the hull. For example, in other embodiments, the depth of the channel may alternatively increase from the bow to a first point located somewhere along the length of the hull, and then decrease from that first point, or from a second point rearward of the first point, to the stern.

Those skilled in the art may conceive of further variations and modifications. All such variations and modifications are believed to be in the scope of the present invention.

What is claimed is:

1. A hull configuration having a bow and a stern, for use in a single or multiple hull vessel, the hull configuration comprising:

a pair of cutting edges, each cutting edge sloping rearwardly, downwardly and in an outwardly lateral direction, from said bow;

a pair of keels, each keel extending longitudinally rearwardly and laterally inwardly from an end of a respective one of said cutting edges;

a pair of sidewalls, each sidewall extending generally upwardly from a respective one of said cutting edges and from a respective one of said keels, said sidewalls extending rearwardly to the stern; and a bottom channel defined between said cutting edges and between said keels, said channel comprising a forward portion having a concave upper surface and rearward portion having a planar upper surface, said planar upper surface of said rearward portion extending from proximal a midpoint between the bow and the stern to the stern, said channel decreasing in width from ends of said cutting edges towards said stern, the concave upper surface of the channel blending smoothly with the planar upper surface of the channel proximal the midpoint between the bow and the stern, wherein an inner surface of each keel is generally vertical and defines a generally right angle with the planar upper surface of the channel, the generally vertical inner surfaces and said planar upper surface converging at said stern, and wherein the planar upper surface provides an area for even distribution of trapped air pressure across said rearward portion of said channel at cruising speed.

2. The hull configuration according to claim 1, wherein each of said sidewalls spiral rearwardly from a respective one of said cutting edges.

3. The hull configuration according to claim 2, wherein each of said sidewalls extend inwardly and upwardly proximal the bow, substantially vertically proximal the midpoint between the bow and the stern, and substantially vertically proximal the stern.

4. The hull configuration according to claim 1, wherein the forward portion of the channel blends smoothly with the rearward portion of the channel.

5. The hull configuration according to claim 4, wherein the forward portion of the channel blends smoothly with the rearward portion of the channel at said midpoint between the bow and the stern.

6. The hull configuration according to claim 1, wherein the depth of the channel increases from the bow proximal a midpoint between the bow and the stern, and decreases rearwardly therefrom to the stern.

* * * * *